US006692425B2

(12) United States Patent
Myers et al.

(10) Patent No.: US 6,692,425 B2
(45) Date of Patent: Feb. 17, 2004

(54) FOLDING PRESSER ASSEMBLY

(75) Inventors: Rick D. Myers, Conyers, GA (US); David J. Coursey, Conyers, GA (US)

(73) Assignee: SDC Innovations, Inc., Decatur, GA (US)

( * ) Notice: Subject to any disclaimer, the term of this patent is extended or adjusted under 35 U.S.C. 154(b) by 0 days.

(21) Appl. No.: 10/054,127

(22) Filed: Oct. 22, 2001

(65) Prior Publication Data

US 2002/0160899 A1 Oct. 31, 2002

Related U.S. Application Data

(63) Continuation-in-part of application No. 09/845,677, filed on Apr. 30, 2001.

(51) Int. Cl.[7] ..... B31B 1/28

(52) U.S. Cl. ..... 493/468; 493/473; 493/480; 493/373

(58) Field of Search ..... 493/468, 467, 493/473, 475, 478, 480, 373, 340, 143

(56) References Cited

U.S. PATENT DOCUMENTS

| | | | | | |
|---|---|---|---|---|---|
| 707,803 | A | * | 8/1902 | Smith | |
| 1,260,345 | A | * | 3/1918 | Dies | |
| 1,414,354 | A | * | 5/1922 | Gibbs | |
| 3,107,716 | A | * | 10/1963 | Wehmeyer | |
| 3,782,166 | A | * | 1/1974 | Whistler et al. | |
| 4,452,595 | A | * | 6/1984 | Huff | 493/373 |
| 4,921,154 | A | * | 5/1990 | Abe et al. | |
| 5,049,122 | A | | 9/1991 | Marschke | 493/373 |
| 5,087,236 | A | * | 2/1992 | Morimoto | 493/373 |
| 5,100,040 | A | | 3/1992 | Kunreuther et al. | 225/103 |
| 5,156,584 | A | | 10/1992 | Cohen et al. | 493/472 |
| 5,178,600 | A | | 1/1993 | Harder | 493/162 |
| 5,179,882 | A | | 1/1993 | Takeuchi et al. | 83/125 |
| 5,222,717 | A | | 6/1993 | Traficant | 254/122 |
| 5,474,219 | A | * | 12/1995 | Mano | 493/373 |
| 5,529,565 | A | | 6/1996 | Oetlinger | 493/468 |
| 5,599,269 | A | | 2/1997 | Oetlinger | 493/468 |
| 5,605,527 | A | | 2/1997 | Gillieron | 493/342 |
| 5,735,442 | A | | 4/1998 | Emrich | 225/1 |
| 5,766,123 | A | | 6/1998 | Oetlinger | 493/468 |
| 5,810,233 | A | | 9/1998 | Varidel | 225/97 |
| 5,893,825 | A | | 4/1999 | Rebeaud | 493/468 |
| 5,971,378 | A | | 10/1999 | Sweeney | 269/6 |
| 6,045,122 | A | | 4/2000 | Torres | 254/88 |
| 2003/0107167 | A1 | | 6/2003 | Oetlinger | |
| 2003/0116036 | A1 | | 6/2003 | Oetlinger | |
| 2003/0119643 | A1 | | 6/2003 | Oetlinger | |

* cited by examiner

*Primary Examiner*—Eugene Kim
*Assistant Examiner*—Sameh H. Tawfik
(74) *Attorney, Agent, or Firm*—Kilyk & Bowersox, P.L.L.C.

(57) ABSTRACT

A presser assembly for supporting blanking scrap during a blanking operation is provided. The presser assembly includes a support rail; a presser rail connected to the support rail; and at least one connecting rail connecting the presser rail to the support rail. The connecting rail is adapted to pivot with respect to at least one of the support rail and the presser rail through a predetermined pivot angle range for changing a distance between the support rail and the presser rail. By pivoting, a folding and an unfolding of the presser assembly can be affected during a blanking operation.

47 Claims, 10 Drawing Sheets

14
44
46
48
50
100
115
116
120
125
126
$R_{S_1}$
$R_{S_2}$
$R_{S_3}$
$R_{S_4}$
a
b
c
d
e
f
g
h1
h2
i
j
k
m
n
p

16/18
150
142
144
146
141
28/30
136
134
135
140
52/54
85
84
132
130
138
148
Rc1
Rc2
Rc3

230
240
242
244
246
254
256
252
258
254
230
236
238
258
250
234
230
232
248

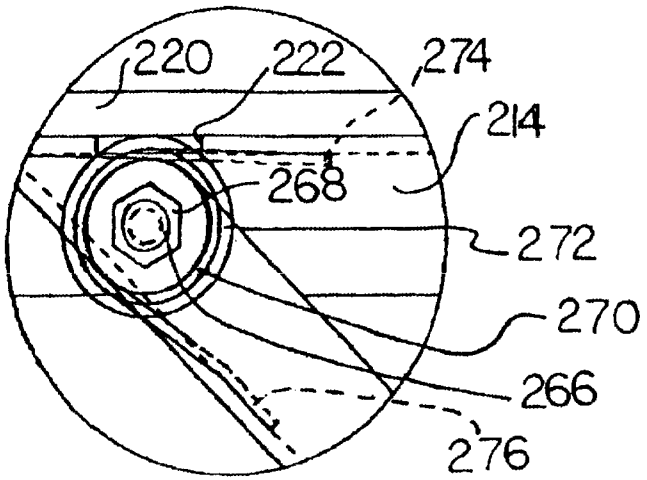
Fig. 11c
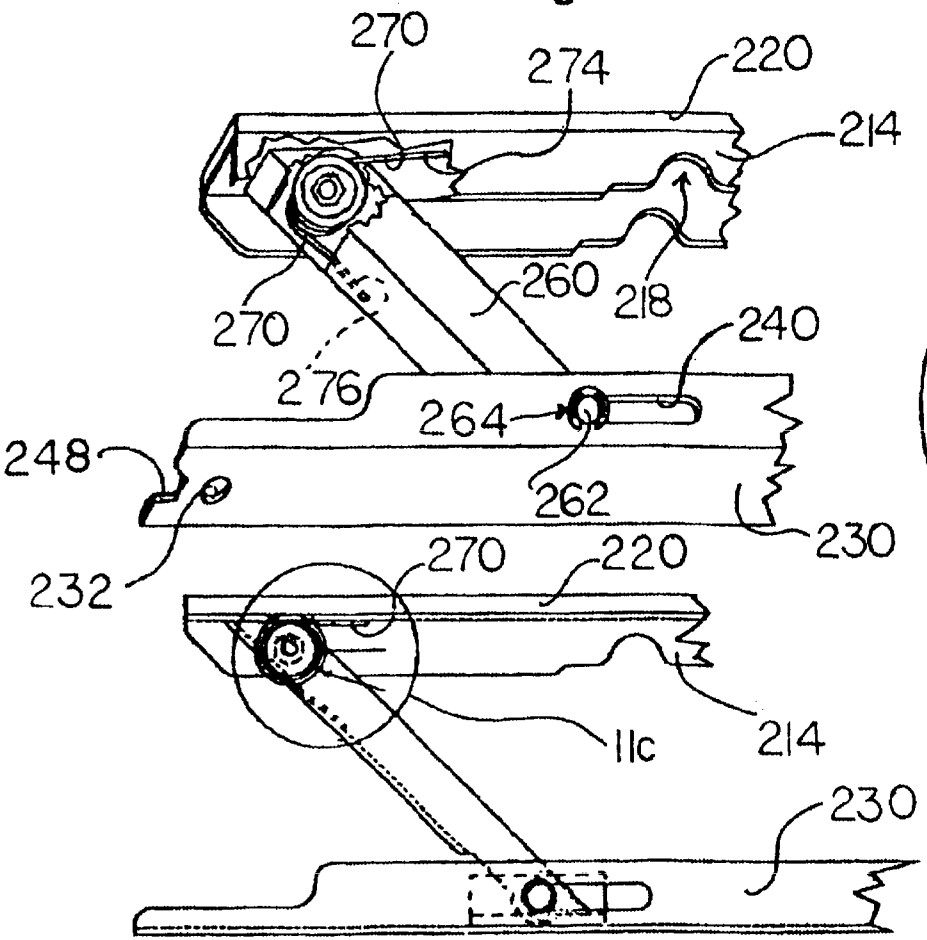
Fig. 11a
Fig. 11b

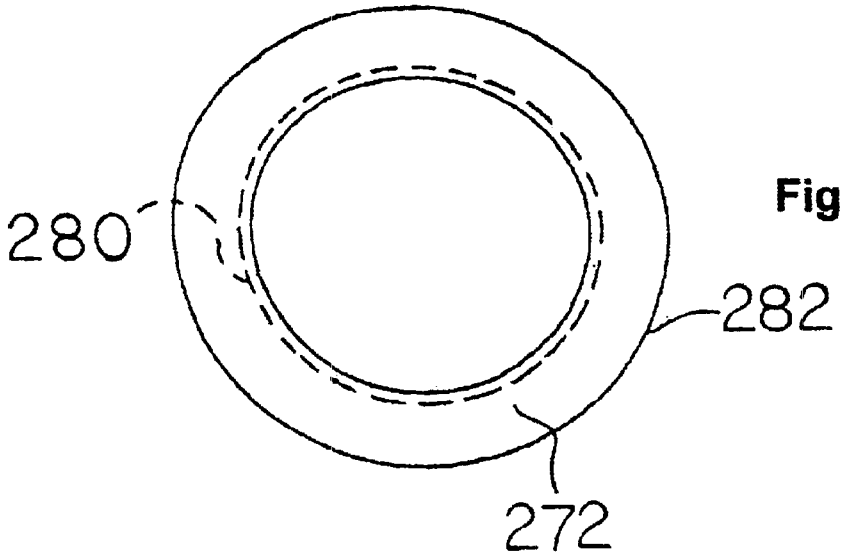
Fig. 12a
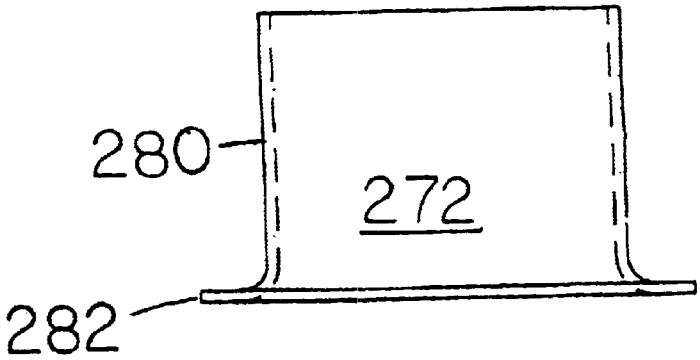
Fig. 12b
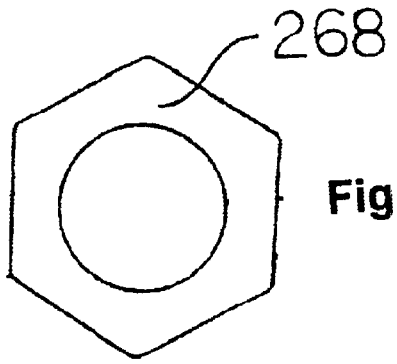
Fig. 13a
Fig. 13b
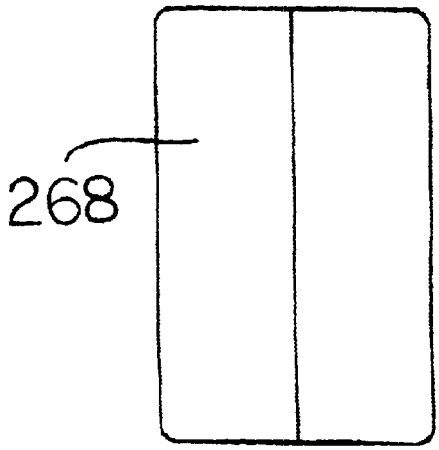

FOLDING PRESSER ASSEMBLY

CROSS REFERENCE TO RELATED APPLICATION

This application is a continuation-in-part of U.S. patent application Ser. No. 09/845,677 filed on Apr. 30, 2001, which is incorporated herein in its entirety by reference.

BACKGROUND OF THE INVENTION

1. Technical Field of the Invention

This invention generally relates to a presser assembly for a blanking operation, and, more particularly, to a presser assembly for supporting and/or advancing blanking scrap, such as paper, paperboard, or carton blanking scrap, during a blanking operation.

2. Description of Related Art

In the manufacture of cartons and paper products, small sheets of material are typically cut out of larger sheets. These smaller sheets are known as blanks that, in turn, may be further formed into various shapes, such as, by way of example, into boxes. The blanks are formed during a process known as a blanking operation. In a blanking operation, the blanks are cut, but not removed, from the large sheet of paper, paperboard, or carton material. After the blanks have been cut, the sheet is positioned over a frame for support. The frame typically includes large openings that correspond in size and in position to the blanks previously cut. Below the frame is typically a mechanism for stacking the blanks. In order to knock the blanks from the sheet of material and hold the scrap material, an assembly known in the art as a presser assembly is used. The presser assembly includes a support tool having a presser member and a presser rail depending therefrom. The presser rail is biased away from the support tool. As the support tool is lowered, the presser rail engages the sheet of material such that the sheet of material is secured between the presser rail and the frame. The support tool continues to be lowered such that the presser member engages the blanks and knocks the blank out of the sheet of material. The carton blanks fall onto a stacking mechanism wherein the blanks are stacked.

If the presser rail does not adequately hold the blanking scrap, the scrap may fall onto the stacking mechanism. A carton blanking scrap in the stacking mechanism may jam the mechanism thereby causing downtime and expense. In order to securely hold the carton blank scrap, one conventional presser assembly provides presser rails interconnected to the support tool by a plurality of guide cylinders. Each guide cylinder biases the presser rail away from the support tool. This gives the presser rail a certain amount of flexibility when engaging the carton blanking scrap. However, even with this limited flexibility, present day presser rails and assemblies have been found to be inadequate and require substantial assembly and various parts. An example of such a presser assembly is described in U.S. Pat. No. 5,529,565, the subject matter of which is incorporated herein in its entirety by reference.

The prior art fails to provide a presser assembly that offers a simple configuration, requires low cost to manufacture, is easy to assemble, and that is easily and efficiently mountable to a backer board of a blanking device.

SUMMARY OF THE INVENTION

It is a purpose of the present invention to solve the above-mentioned problems.

To achieve the above purpose, the present invention provides a presser assembly for supporting blanking scrap during a blanking operation. The presser assembly includes: a support rail; a presser rail connected to the support rail; and a connecting rail connecting the presser rail to the support rail and being adapted to pivot with respect to at least one of the support rail and the presser rail through a predetermined pivot angle range. The pivot angle range is for changing a distance between the support rail and the presser rail to thereby selectively affect a folding and an unfolding of the presser assembly during the blanking operation.

The present invention further encompasses a die cutting or blanking press that includes a presser assembly for supporting blanking scrap during a blanking operation. The assembly includes: a support rail; a presser rail adapted to be connected to the support rail; and a connecting rail adapted to connect the presser rail to the support rail and adapted to pivot with respect to at least one of the support rail and the presser rail in an assembled state of the presser assembly. The pivoting is through a predetermined pivot angle range for changing a distance between the support rail and the presser rail thereby selectively effecting a folding and an unfolding of the presser assembly during the blanking operation. The assembly is operatively mounted on the die cutting or blanking press to support and/or advance a blank sheet or blanking scrap in a blanking operation.

Moreover, the present invention provides a presser assembly for supporting blanking scrap during a blanking operation, where the presser assembly includes: a support means; a presser means connected to the support means and supported thereby; and a connecting means for connecting the presser means to the support means and being adapted to pivot with respect to the presser means through a predetermined pivot angle range for changing a distance between the presser means and the support means thereby selectively affecting a folding and an unfolding of the presser assembly during the blanking operation.

Additionally, the present invention provides a method of using a presser assembly as described above. The method comprises the steps of: pivoting the connecting rail or means with respect to at least one of the support rail or means and the presser rail or means for reducing an angle defined therebetween, thereby folding the presser assembly for reducing a distance between the presser rail and the support rail; and pivoting the connecting rail or means with respect to at least one of the support rail or means and the presser rail or means for increasing an angle defined therebetween, thereby unfolding the presser assembly for increasing a distance between the presser rail or means and the support rail or means.

The present invention also provides a method of forming blanks from a blanking sheet, where the method includes support and/or advancing a blanking sheet and a blanking press through the use of a presser assembly as described above. According to a first embodiment of such a method, a presser assembly according to an embodiment of the present invention is used to hold, support, or secure a blanking sheet in a blanking press during a die cutting or blank forming operation. According to such an embodiment, the presser rail or presser means of the assembly contacts and biases the blanking sheet against a press support or counterplate positioned on a side of the blanking sheet which is opposite the side contacted by the presser rail or presser means, during a die cutting or blank forming operation. The blank sheet is thereby supported and stabilized during the die cutting operation to facilitate efficient and clean blank formation.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and are not intended to limit the present invention. In the drawings:

FIG. 11*a* is a perspective, partial cutaway view of an end of a presser bar according to another embodiment of the present invention;

FIG. 11*b* is a side in partial phantom of the presser bar embodiment shown in FIG. 11*a;*

FIG. 11*c* is an enlarged view of circle portion 11*c* shown in FIG. 11*b;*

FIGS. 12*a* and 12*b* are an end view and side view, respectively, of a furrel used in the coil spring of the embodiment of the present invention shown in FIGS. 11*a*–11*c*; and FIGS. 13*a* and 13*b* are an end view and side view, respectively, of a hexagonal guide bushing for a coil spring rivet used in connection with the coil spring and furrel feature of the embodiment of the present invention shown in FIGS. 11*a*–11*c*.

DETAILED DESCRIPTION OF THE PREFERRED EMBODIMENTS

The present invention overcomes the problems of the prior art by providing a presser assembly of simple construction having fewer components than presser assemblies of the prior art that use guide cylinders. The presser assembly of the present invention therefore tends to advantageously be less costly to manufacture, can be easily and completely assembled prior shipment to die-cutting converters, and are easier to install. There is no need for the end user, or die-cutting converter, to assemble the presser assembly as it can be shipped in a completely assembled. The presser assembly according to the present invention is further, in an advantageous manner, easily and efficiently mountable to a backer board of a blanking device.

In order to achieve the above advantages, the present invention provides a presser assembly that includes at least one, and preferably two, connecting rails between a support rail and a presser rail. The at least one connecting rail establishes and maintains a distance between the support rail and the presser rail, and is advantageously pivotable with respect to at least one of the support rail and the presser rail for allowing the presser assembly to be folded and unfolded, thereby reducing a distance between the support rail and the presser rail. An unfolding of the presser assembly would then involve a pivoting of the connecting rail with respect to at least one of the support rail and the presser rail such that a distance between the support rail and the presser rail is increased. The ability to decrease and increase the distance between the support rail and the presser rail, as recognizable by those skilled in the art, advantageously allows an efficient and clean blanking operation to take place. The fact of using at least one, and preferably two, connecting rails according to the present invention greatly simplifies the construction of a presser assembly and makes mounting of the presser assembly simple and efficient.

By "rail," what is meant in the context of the present invention is any rigid member the length of which does not vary during a folding and unfolding of the presser assembly. Furthermore, a distance between the support rail and the presser rail may be "changed" according to the present invention by moving the support rail and the presser rail with respect to one another in either a translational movement and/or a pivoting movement of the support rail with respect to the presser rail. In either case, a distance between the support rail and the presser rail is changed. In addition, by "folding" the presser assembly, what is meant in the context of the present invention is a pivoting of parts of the presser assembly with respect to one another to draw the parts together and to make the assembly more compact.

Figure 1:
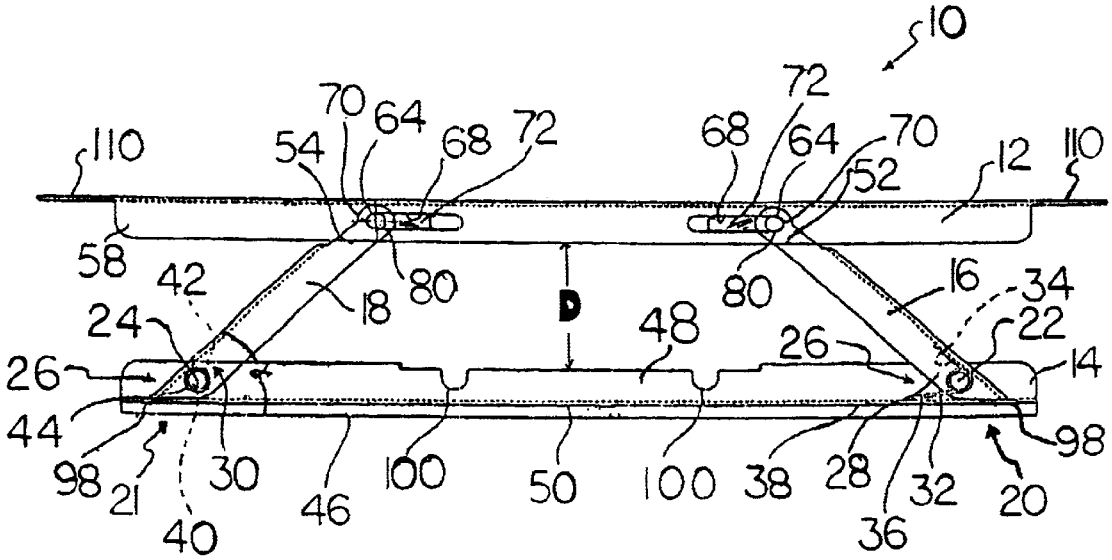
FIG. 1 is a front-elevational view of a preferred embodiment of a presser assembly according to the present invention.
Figure 2:
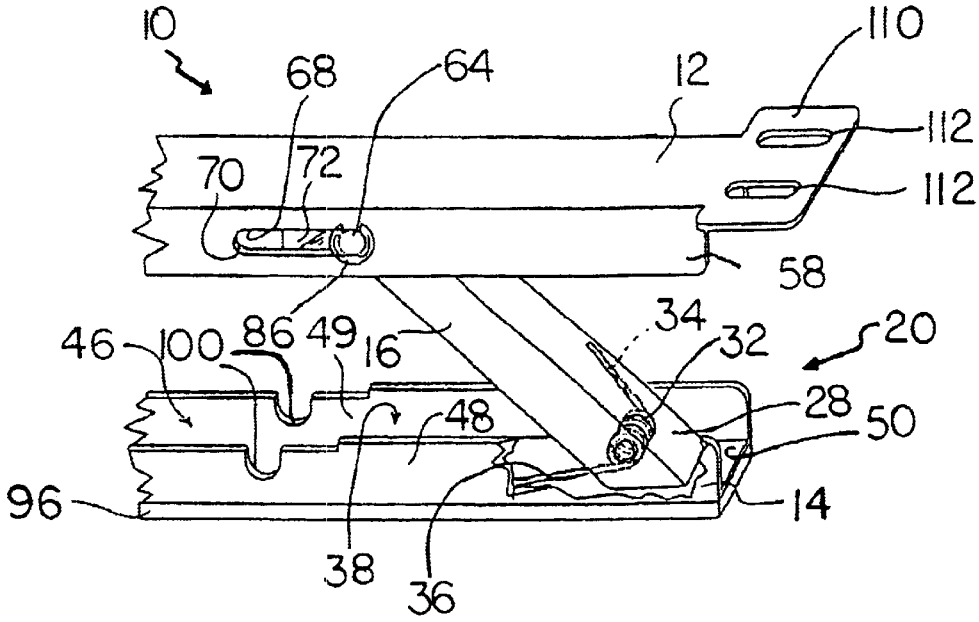
FIG. 2 is a perspective, partially cut-away and enlarged view of a portion of the presser assembly shown in FIG. 1 showing a biasing mechanism according to a preferred embodiment of the present invention.
Figure 3:
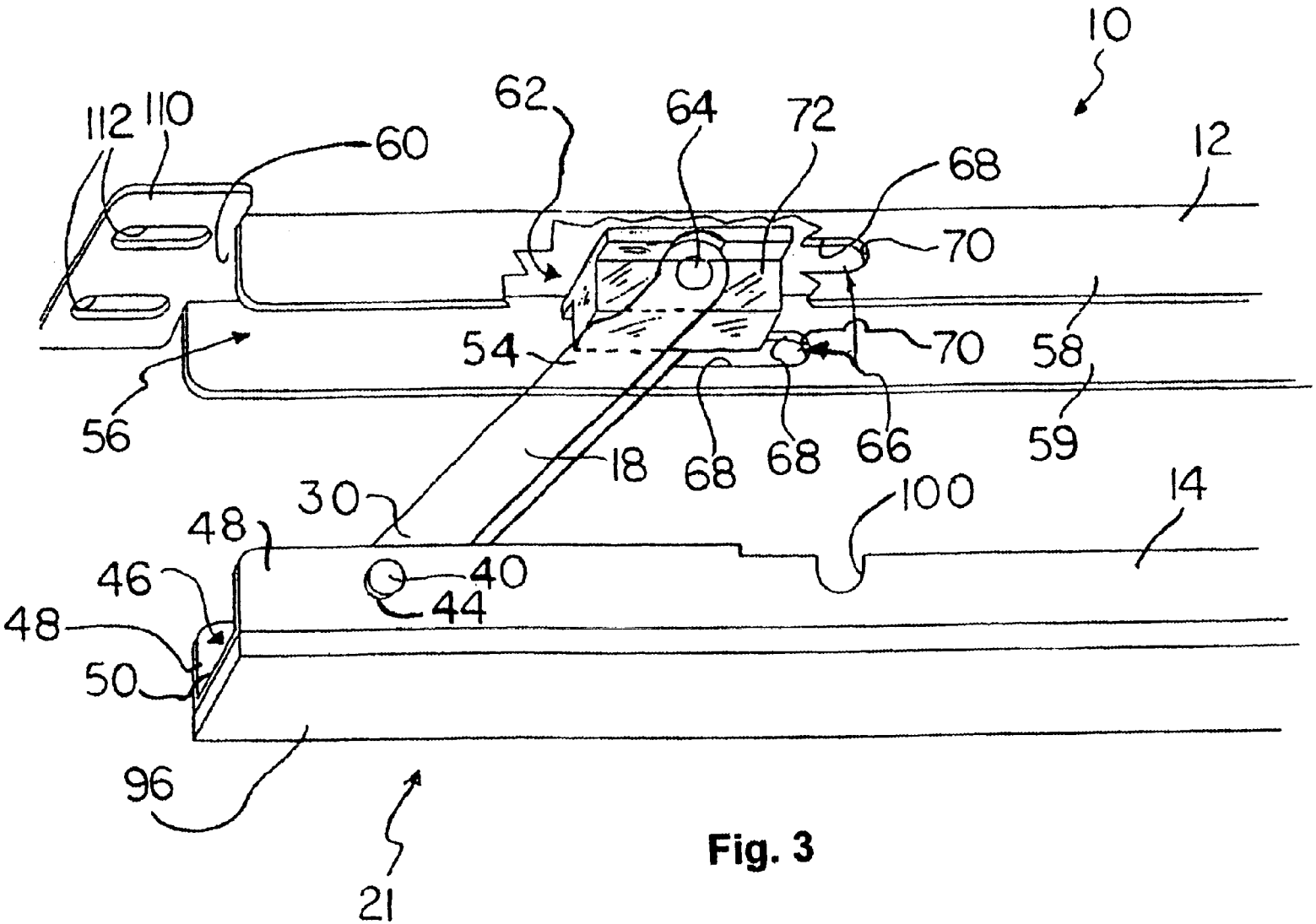
FIG. 3 is a perspective, partially cut-away and enlarged view of a portion of the presser assembly shown in FIG. 1 showing a sliding mechanism according to a preferred embodiment of the present invention.

With reference to the drawings, FIGS. 1–3 show a preferred embodiment of the present invention. As seen in FIG. 1, a preferred embodiment of the present invention includes a presser assembly 10 for supporting blanking scrap during a blanking operation. Presser assembly 10 includes a support rail 12 and a presser rail 14 connected to the support rail as shown. At least one, and preferably two, connecting rails 16, 18 connect the presser rail 14 to the support rail 12. In the shown preferred embodiment of the present invention, a first connecting rail 16 and a second connecting rail 18 connect the presser rail 14 to the support rail 12, respectively, at a first end 20 and at a second end 21 of the presser rail 14. The first connecting rail 16 and the second connecting rail 18 are each adapted to independently pivot with respect to at least one of the support rail 12 and the presser rail 14 for changing a distance between the support rail and the presser rail, thereby enabling folding of the presser assembly during the blanking operation. In the shown preferred embodiment, the first connecting rail 16 and the second connecting rail 18 are pivotable with respect to presser rail 14 at respective pivot points 22 and 24 as shown. Preferably, the ratio of the distance between the holes defining pivot points 22 and 24 and the length of the presser rail 14 is about 0.8 or greater. The support rail 12 and the presser rail 14 are biased away from one another by biasing mechanisms 26. The biasing mechanisms shown are coupled to presser ends 28 and 30 of the first connecting rail 16 and the second connecting rail 18, respectively. However, it is to be understood that the present invention includes within its scope a biasing mechanism that is coupled to at least one of two ends of one or more connecting rails connecting the support rail with the presser rail. In a preferred embodiment of the present invention, the biasing mechanism 26 comprises a torsion spring 32, shown in phantom in FIG. 1 and in partial phantom in FIG. 2, at only the presser end of the first connecting rail 16, it being understood that a torsion spring (not shown) is also provided at presser end 30. Each torsion spring includes a distal arm 34 and a proximal arm 36, the distal arm 34 resting against a corresponding one of the first connecting rail 16, there being a similar arrangement for the second connecting rail 18. The proximal arm 36 rests against a trough 38 of the presser rail 14. Each torsion spring 32 in this way biases the corresponding connecting rail to establish, with other separation limiting means, a default distance D between the support rail 12 and the presser rail 14. In this way, the connecting rails define an angle $\alpha$ between each connecting rail and the presser bar. The angle $\alpha$ at the default distance is preferably from about 30° to about 60°, for example, from about 40° to about 50°. More preferably, the angle $\alpha$ is about 45 degrees. As shown in FIGS. 1–3, the connecting rails, presser rail, support rail, and the presser assembly are in their default modes, or positions.

Preferably, according to the present invention, the presser assembly 10 further includes first pins 40, only one of which is depicted in FIGS. 1–3, each pin 40 respectively extending through a respective presser end 28 or 30 of the first connecting rail 16 and the second connecting rail 18, respectively, for pivotally securing the first connecting rail and the second connecting rail to the presser rail. While only one pin 40 is shown in FIG. 1, it is to be understood that there is a pin 40 provided to secure a respective torsion spring 32 to each presser end of each of the first connecting rail 16 and the second connecting rail 18. The pin 40 preferably extends through holes 42 in each of the presser ends 28 and 30, and through corresponding holes 44 at the first end 20 and second end 21 of the presser rail 14. It is to be understood that, similar to pin 40, although only one series of holes 40 and 42 are shown in FIG. 1, identical holes are provided at both the first end 20 and the second end 21 of the presser rail 14, and at both presser ends 28 and 30 corresponding to both connecting rails 16 and 18.

Referring now to FIG. 2 specifically, a perspective view is provided of the presser assembly shown in FIG. 1 in its default mode showing a portion thereof adjacent the first end 20 of presser rail 14. It is to be understood, however, that according to a preferred embodiment of the present invention, each end of the presser assembly is identical to or a mirror image of the other end thereof Therefore, descriptions regarding FIG. 2 and pertaining to portions of the presser assembly adjacent first end 20 of presser rail 14 apply equally to the portions of the presser assembly adjacent second end 21 of presser rail 14. As shown in FIG. 2, the presser rail is preferably an elongated member defining a trough 46 therein. The trough 46 is more preferably defined between two parallel sidewalls 48, 49, and a bottom wall 50, presser ends 28 and 30 resting against bottom wall 50, and proximal arm 36 of torsion spring 32 further resting against and being biased against bottom wall 50. Referring to FIG. 1, the first connecting rail 16 and the second connecting rail 18 respectively further have support ends 52 and 54 and are further pivotally secured to the presser rail. The presser ends 28 and 30 thereof are disposed in the trough 46.

Referring now to FIG. 3, a portion of presser assembly 10 including second end 21 of presser rail 14 is shown. Similar to FIG. 2, descriptions regarding FIG. 3 and pertaining to portions of the presser assembly adjacent and including second end 21 of presser rail 14 apply equally to the portions of the presser assembly adjacent and including first end 20 of presser rail 14. As shown in FIGS. 1–3, according to a preferred embodiment of the present invention, the support rail 12 is an elongated member defining a trough 56 therein, the first connecting rail 16 and the second connecting rail 18 are each slidably guidable within the trough at support ends thereof. Trough 56 is defined between parallel sidewalls 58, 59, and top wall 60 of the support rail 12.

Support ends 52 and 54 of connecting rails 16 and 18 are preferably made slidably guidable in trough 56 by providing two pairs of guide slots in support rail 12 according to the present invention. Additionally, a sliding mechanism 62 is provided for effecting a sliding of the support ends of the first connecting rail and the second connecting rail within the trough 56. The sliding mechanism preferably includes a guide pin 64 extending through a respective support end 52 and 54. As shown in FIG. 3, the pins 64 are slidably guidable within the guide grooves, as will be explained in further detail below.

A preferred embodiment of the present invention is shown in FIG. 3 and includes two pairs of guide slots 66, one pair of which is shown. A first pair of the two pairs of guide slots is preferably disposed adjacent the support end 52 of the first connecting rail 16, and is configured for guiding one of the guide pins 64 therein. The second pair 66 (shown in FIG. 3) of the two pairs of guide slots is preferably disposed adjacent the support end 54 of the second connecting rail 18 and is configured for guiding the other one of the guide pins 64 therein. Each pair 66 of guide slots more preferably includes two opposite and facing elongated holes 68, each defined in a respective sidewall 58 of the support rail 12. Referring now to both FIGS. 1 and 3, as the connecting rails 16 and 18 are pivoted so as to reduce angle a and reduce default distance D, each guide pin 64 slides forward in its corresponding slot 68, with each lateral part of each slot 68 serving as a stop for its corresponding guide pin. Therefore, in a default mode of the connecting rails, outer edges 70 of each slot 68 determine a stopping position of each connecting rail as it is biased outward, as readily recognizable by those skilled in the art.

Referring to FIGS. 1–3, the sliding mechanism 62 further preferably includes a glide support 72 for each of the connecting rails 16 and 18, the glide support for connecting rail 18 being shown in FIG. 3. The glide support in the preferred embodiment of the present invention is connected to the support ends 52 and 54 of the first connecting rail 16 and the second connecting rail 18, respectively. Each glide support 72 is further configured to be guided within trough 56 for slidably guiding the support ends in the trough.

Figure 5A:
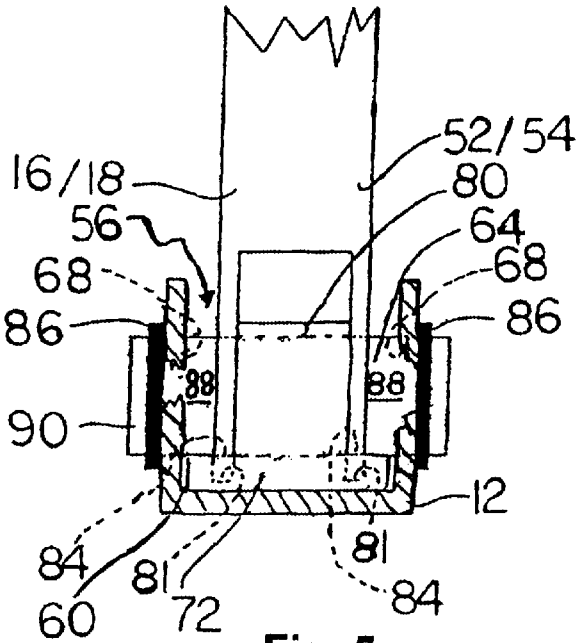
FIG. 5*a* is a partially cut-away and broken-away end view of the device shown in FIG. 1 depicting the connecting rail connected to the support rail.
Figure 4:
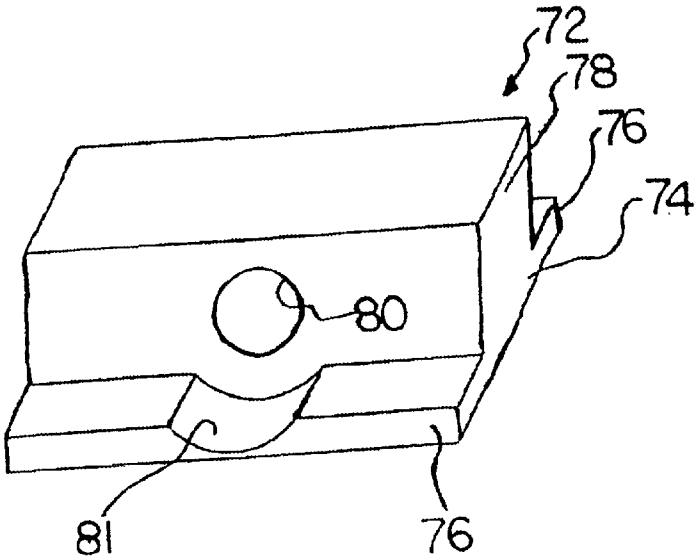
FIG. 4 is a perspective view of a glide support according to a preferred embodiment of the present invention.

FIG. 4 depicts a perspective view of a preferred embodiment of a glide support 72 according to the present invention. As seen in FIG. 4, each glide support 72 includes an extended base portion 74 having side edges 76, and a narrowed head portion 78 defining a hole 80 therein for a guide pin 64. The glide support further preferably defines curved recesses 81 on each side thereof at a central region of its base portion for accommodating a pivoting motion of a corresponding end of a connecting rail. Thus, as readily recognizable by one skilled in the art, and as seen in FIGS. 3 and 5*a*, each connecting rail is connected to its corresponding glide support 72 by being fastened thereto by way of guide pin 64 extending through hole 80 (FIG. 4) of the glide support. Each glide support rests within the trough 56. The side edges 76 substantially abut the inner surfaces of sidewalls 58 of support rail 12. Thus, each glide support 72 is slidably guided within trough 56, in turn slidably guiding each support end of each connecting rail with respect to the support rail.

Figure 5B:
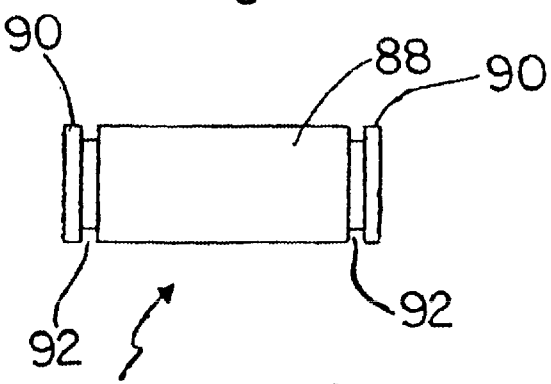
FIG. 5*b* is a front view of a guide pin as could be used in the embodiment of FIG. 1 according to a preferred embodiment of the present invention.
Figure 5C:
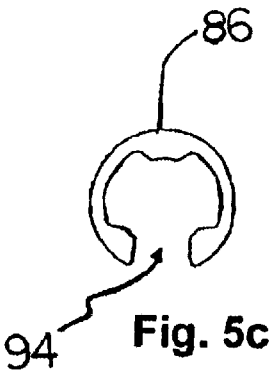
FIG. 5*c* is a front view of one of the locking rings shown in FIG. 5*a* according to a preferred embodiment of the present invention.

Referring now to FIGS. 5*a* through 5*c*, connecting parts for connecting the support end of each connecting rail to its glide support and to the support rail are shown. As seen in FIG. 5*a*, a cross section of the portion of each support end 52/54 of each connecting rail 16, 18 connected to the support rail 12 is shown in a plane transverse to the longitudinal direction of the support rail. Pin 64 extends through the slots 68 in the support rail 12, through corresponding holes 84 in the respective support end 52/54, and through hole 80 in each glide support 72 as shown. Each pin 64 is held in position by a pair of locking rings 86. As an alternative to pin 64 and rings 86, respective rivets can be used to permanently secure the respective support ends 52/54 of respective connecting rails 16, 18, to the support rail 12. If rivets are used, they would preferably extend through slots 68 in the support rail 12, through holes 84 in the support ends of the connecting rails, and through holes 80 in each glide support.

Referring now to FIG. 5*b*, a side view of a preferred embodiment of a guide pin 64 is shown. The guide pin preferably has a body portion 88 adapted to extend within trough 56 of support rail 12, and end portions 90. Guide pin 64 has recesses 92 between each end portion 90 and the body portion 88 for accommodating a respective locking ring 86 (FIG. 5*c*) therein. As seen in FIG. 5*c*, the locking ring 86 is preferably substantially annular, and defines an opening 94 adapted to be snapped onto the guide pin 64 at a corresponding recess 92 of the guide pin 64. As mentioned above, rivets can alternatively be used. The above arrangement ensures a secure slidable guiding connection between each connecting rail and the support rail. Preferably, a lubricant (not shown) is disposed in the trough for lubricating a sliding motion of each glide support within the trough. The lubricant may be disposed on trough surfaces of the support rail 12, at the underside of each glide support, and preferably on surface 60 along the entire sliding path of each glide support. The glide support 72 can be made of a self-lubricating material and/or a polytetrafluoroethylene or NYLATRON material.

Figure 8B:
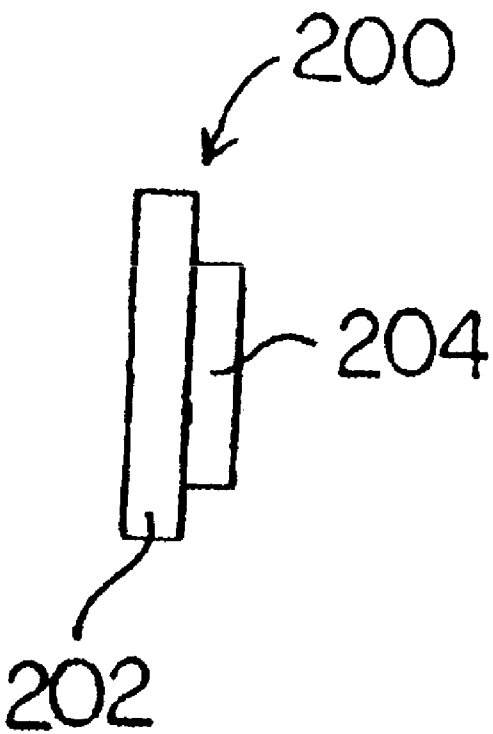
FIGS. 8*a* and 8*b* are an end view and side view, respectively, of a bushing used in connecting the support rail to the connecting rails according to an embodiment of the present invention.
Figure 8A:
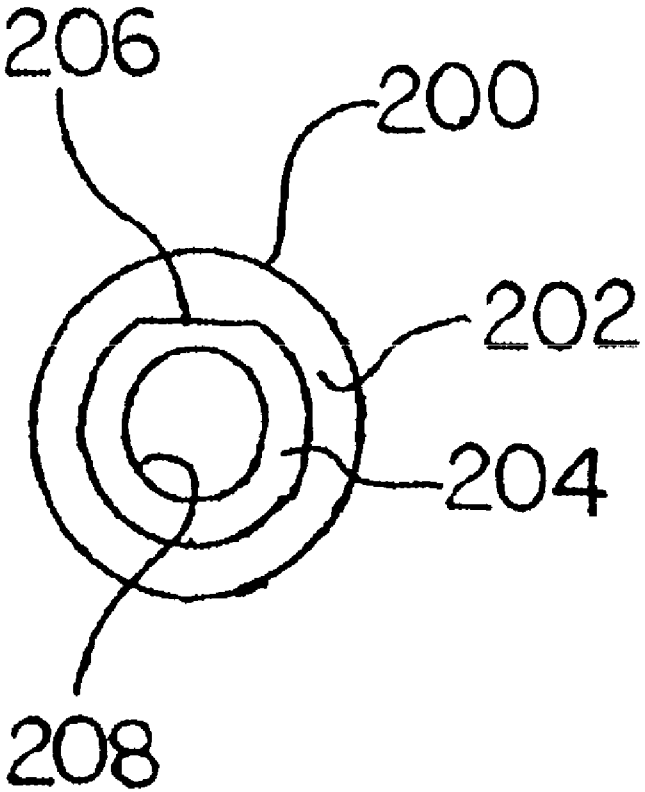

According to an embodiment of the present invention, the holes 84 in the support ends 52/54 of the connecting rails can be fitted with bushings such as bushings 200 shown in FIGS. 8*a* and 8*b*. Bushings 200 include a smaller diameter portion 204 and a larger diameter portion 202. The smaller diameter portion 204 is designed to rest snugly in a corresponding hole 84 of a respective connecting rail, and the larger diameter portion 202 is designed to be disposed between the connecting rail and the support rail 12. The smaller diameter portion is provided with a flattened portion 206 that is designed to mate with a corresponding squared-off portion of a hole (not shown) in a connecting rail, thereby preventing rotation of the bushing 200 in the hole of the connecting rail. The bushing 200 is also provided with a through hole 208 through which a guide pin or rivet can extend.

As seen in FIGS. 1 through 3, the presser assembly according to the present invention preferably includes a pad 96, preferably made of a rubber or a similar, frictionally engaging, material. The pad 96 can be fixed to a lower surface of the presser rail 14 for frictionally engaging a scrap or blank sheet therewith during a blanking operation. Preferably, the presser rail further defines two pairs of facing recesses 100 therein. As best seen in FIG. 2, each pair of the two pairs of recesses includes a first recess 100 in one sidewall 48 of the presser rail 14 and a second recess 100 in another, facing sidewall 49 of the presser rail 14. The recesses of each pair are in registration in a direction transverse to a longitudinal direction of the presser rail 14. As seen in FIG. 1, the recesses of each pair are preferably spaced from one another such that, in a fully folded state of the presser assembly, the support rail 12, the connecting rail and the presser rail are substantially parallel to one another, and the first and second guide pins 64 are respectively received in a respective one of the two pairs of recesses 100 for allowing the presser assembly to fold fully, with the presser rail 14 fitting almost fully within the groove 56 of support rail 12.

As shown in FIGS. 1 through 3, a preferred embodiment of the presser assembly according to the present invention includes two assembly flanges 110, one flange on each end of the support rail 12. As seen in FIG. 2, each flange includes one or more through holes 112 therein for allowing a fastening of the presser assembly to a male blanker board.

Optionally, a pair of resting pads 98, as seen in FIG. 1, are provided on bottom wall 50 of the presser rail. Each of the pads 98 is disposed at a respective one of the first end 20 and the second end 21 of the presser rail such that, in a default mode of the first connecting rail 16 and the second connecting rail 18 as shown in FIG. 1, a tip of the presser end of each of the first connecting rail 16 and the second connecting rail 18 rests against a corresponding one of the resting pads. The resting pads advantageously prevent a scratching of the bottom wall 50 of the presser rail 14 by the tip of the presser ends of the connecting rails 16 and 18.

Figures 6A, 6B, 6C:
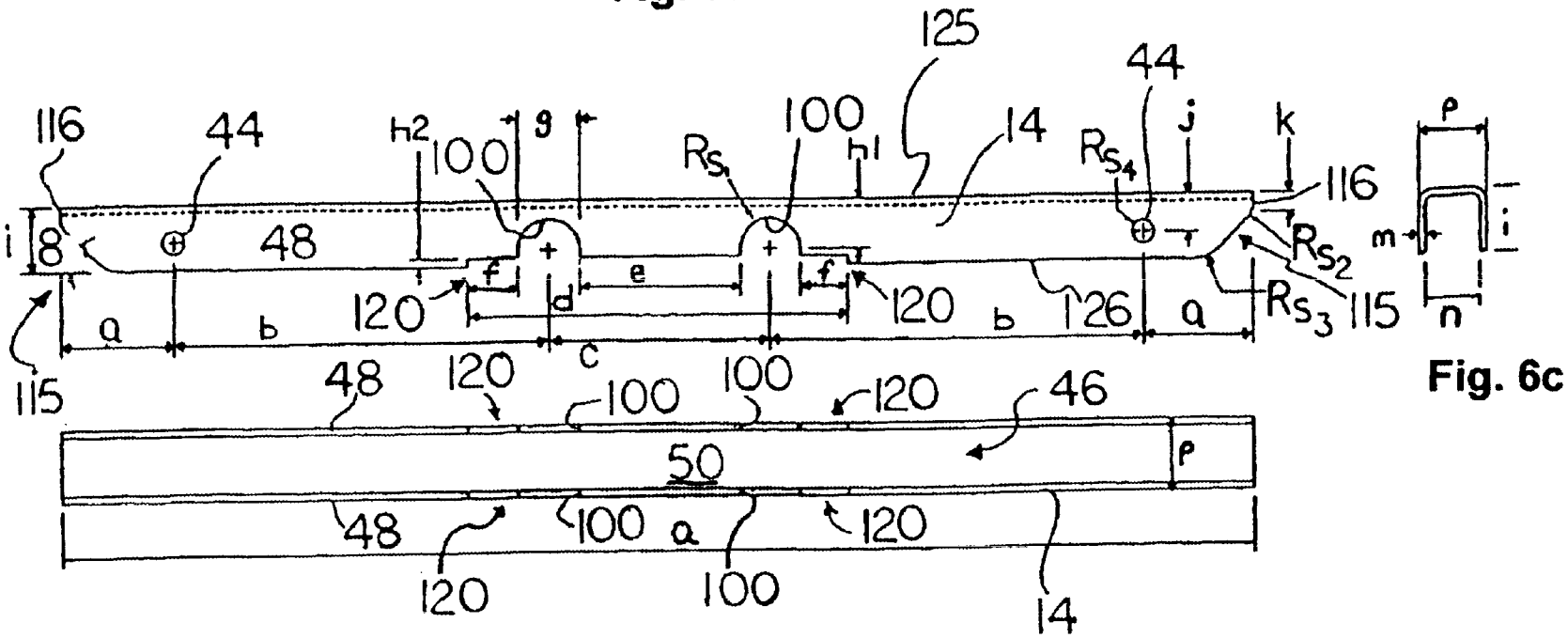
FIG. 6*a* is a side view of a preferred embodiment of a presser rail according to the present invention.
FIG. 6*b* is a bottom plan view of the presser rail shown in FIG. 6*a;*
FIG. 6*c* is an end view of the presser rail shown in FIG. 6*a;*

Referring now to FIGS. 6*a* through 6*c*, a preferred embodiment of a presser rail 14 according to the present invention is depicted. The presser rail 14 shown in FIGS. 6*a* to 6*c* has slanted sides 115 inclined with respect to top surface 125 and bottom surface 126 of the presser rail 14 by an angle $\gamma$, preferably equal to about 45 degrees. Each of the slanted sides 115 has rounded edges defining a radius Rs2 preferably equal to about 0.125 inch and a radius Rs3 preferably equal to about 0.188 inch. Moreover, each of the slanted sides 115 is bounded on one side thereof by a side 116 adjoining outer surface 125 of presser rail 14, and having a height k of about 0.125 inch. A combined height i of sides 115 and 116 is moreover preferably about 0.437 inch. Holes 44 in the presser rail preferably have a radius Rs4 of about 0.155 inch, and semi-circular recesses 100 preferably have a radius Rs1 of about 0.203 inch. A distance h1 from a center of each of the recesses 100 to outer surface 125 is further preferably about 0.329 inch, while a distance j from a center of each of the holes 44 to outer surface 125 is preferably about 0.25 inch. Each recess 100 further preferably has a diameter g of about 0.406 inch. Preferably, the ratio of a distance between the two pairs of recesses and a length of the presser rail is about 0.2 to 1. The inner surface 126 of presser rail 14 defines a linear recess 120 therein at the region of recesses 100 as shown. Recess 120 is provided to accommodate side edges 76 of glide support 72 therein (see FIG. 4) in a fully folded state of the presser assembly. Linear recess 120 preferably has a depth h2 of about 0.062 inch, and a length d that is preferably about 2.562 inches. A distance e between respective inner corners of recesses 100 being preferably about 1.094 inches. Additionally, a distance f between the outer corner of each recess 100 and a closest edge of recess 120 is preferably about 0.328 inch. A distance c between respective centers of recesses 100 is preferably about 1.5 inches, and a distance b between a center of each recess 100 and a center of a hole 44 closest thereto is preferably about 2.5 inches. Moreover, a distance, designated "a", between a center of each hole 44 and a side edge 116 of the presser rail 14, is preferably about 0.75 inch. As seen in FIG. 6*b*, a total length of the presser rail 14 is preferably about 8 inches, and its outer width p is preferably about 0.482 inch. As seen in FIG. 6*c*, an inner thickness n of the presser rail 14 is preferably about 0.386 inch, and its wall thickness m is preferably about 0.048 inch.

Figures 7A, 7B, 7C:
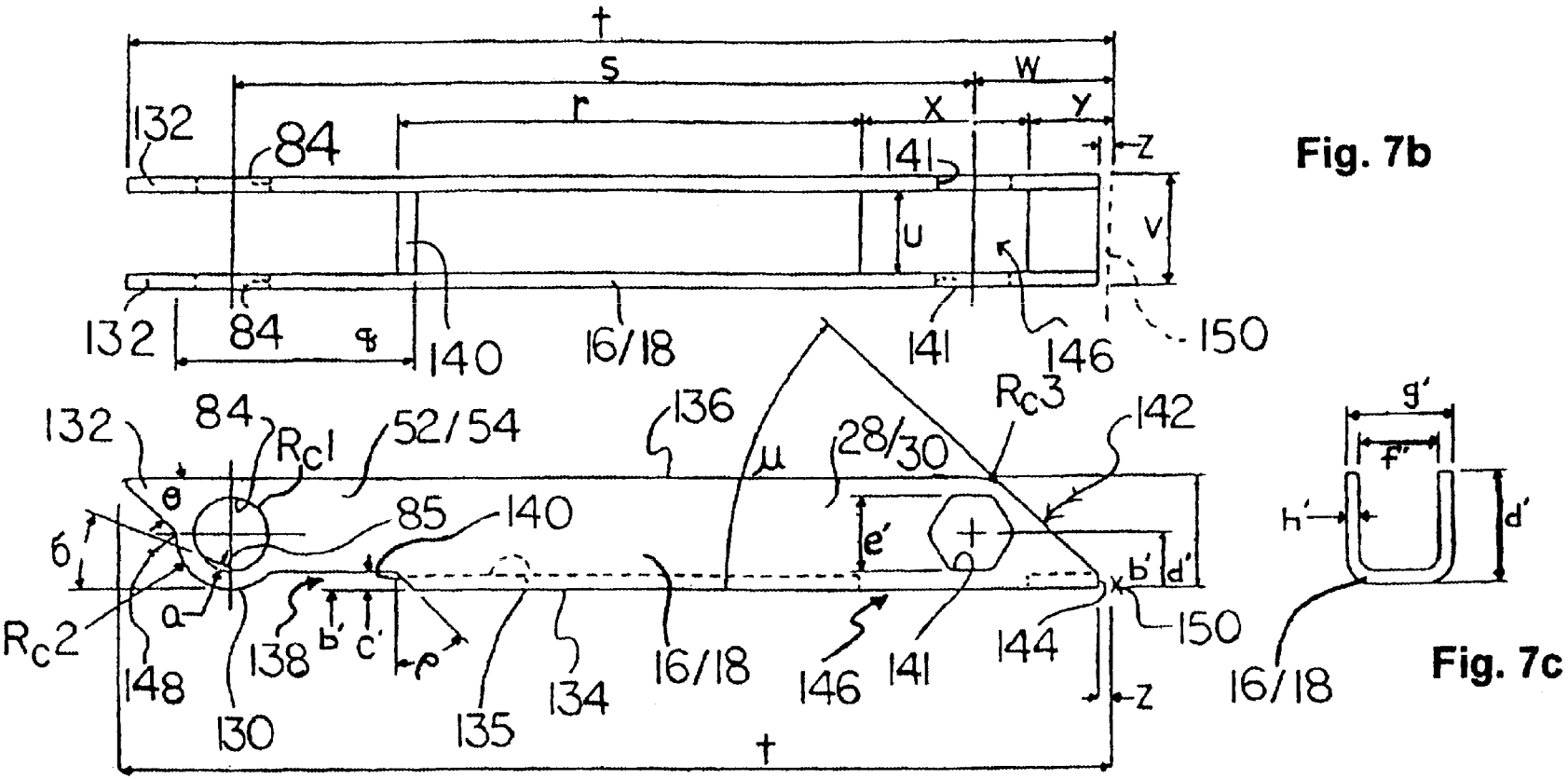
FIG. 7*a* is a side view of a preferred embodiment of a connecting rail according to the present invention.
FIG. 7*b* is a bottom view of the connecting rail shown in FIG. 7*a;*
FIG. 7*c* is a side view of the connecting rail shown in FIG. 7*a;*

As seen in FIGS. 7*a*, 7*b*, and 7*c*, a preferred embodiment of a connecting rail 16, 18 according to the present invention is shown, and includes a support end 28/30, and a presser end 52/54. As seen in FIG. 7*a*, the support end 52/54 has a rounded portion 130 and an angled portion 132. The support end 52/54 further defines support hole 84 for allowing a connection of the connecting rail 16/18 to support rail 12 in a sliding manner, as previously described. Rounded portion 130 defines an outer radius Rc2 of preferably about 0.37 inch, and hole 84 has a radius Rc1 of preferably about 0.251 inch. The hole 84 is adapted to receive a support pin therein, such as pin 64 depicted in FIG. 2, for pivotally securing the connecting rail to the support rail. Hole 84 in the preferred embodiment of FIG. 7*a* has a straight region 85 having a maximum thickness a' relative to the normal curvature of the hole 84 of preferably about 0.02 inch. The straight region stops the rotation of a pin 64 in the hole 84. Straight region 85 further defines an angle δ with respect to outer surface 134 of connecting rail 16/18 that preferably measures about 22.214 degrees. Angled region 132 defines an angle θ of preferably about 44.427 degrees. As suggested in FIG. 3, rounded portion 130 can at least partially be received within recess 81 of glide support 72, and angled portion 132 abuts against glide support 72 in an unfolded mode of the presser assembly and acts as a stop against a further biasing of the support rail 12 away from the presser rail 14. Outer surface 134 defines a recess 138 bounded on one side thereof by rounded portion 130, and on another side thereof by a slanted surface 140. Surface 140 is slanted with respect to a line perpendicular to surface 134 by an angle ρ that is preferably about 45 degrees. A distance b' between a line intersecting a center of hole 84 and parallel to surface 134, on the one hand, and surface 134 on the other hand, is preferably about 0.188 inch. A distance c' between a recessed surface of recess 138 of the connecting rail 16/18 and outer surface 134 preferably measures about 0.063 inch. The connecting rail 16/18 further defines a hole 141 therein that is preferably polygonal as shown. Hole 141 is provided for allowing a pivotal connection of connecting rail 16/18 to presser rail 14, as suggested in FIG. 3, for example, by way of pin 40. Hole 141 moreover has a height e' that is preferably about 0.251 inch.

The connecting rail 16/18 according to a preferred embodiment of the present invention has a slanted side 142 inclined with respect to surfaces 134 and 136 by an angle $\mu$ preferably of from about 40 to about 45 degrees, such as about 42.685 degrees. Slanted side 142 rests, in an unfolded state of the presser assembly 10, against the presser rail 14, and preferably against bottom wall 50 of the presser rail 14 as suggested in FIG. 2. The angle $\mu$ can in turn determine the inclination angle of the connecting rail 16/18 with respect to the presser rail 14 and the support rail 12 in an unfolded state of the presser assembly 10. Slanted side 142 further has a rounded edge at the inner surface 136 thereof defining a radius Rc3 preferably equal to about 0.2 inch, for example, about 0.187 inch. A main function of the rounded edge is to facilitate a pivoting of the connecting rail 16/18 during a folding and unfolding of the presser assembly 10. The rounded edge eliminates or minimizes frictional engagement of the presser rail during a pivoting of the connecting rail 16/18. Moreover, slanted side 142 is bounded on one side thereof adjoining the outer surface 134 of the connecting rail 16/18 by a truncated corner 144 having a height c' of preferably about 0.06 inch, for example, about 0.063 inch. A combined height d' of side 142 is preferably about 0.437 inch. Truncated corner 144 defines a truncation region that truncates the length of the rail 16/18 if otherwise without a truncated corner, by a length z of about 0.05 inch, while the length of the connecting rail 16/18 is preferably about 3.35 inches. The truncation region is defined between surface 144 and an imaginary line 150 coinciding with an extrapolation of surfaces 134 and 142. The outer side of connecting rail 16/18 is further preferably provided with a rectangular opening 146 that, in a fully folded state of the presser assembly, accommodates at least a portion of torsion spring 32 therein.

As seen in FIG. 7*b*, the connecting rail 16/18 of FIG. 7*a* is shown as viewed from its side 134. In this figure, the thickness v of the connecting rail 16/18 is preferably about 0.375 inch. A distance s from a center of hole 84 to the center of hole 141 is preferably about 2.5 inches; a distance r between the edge of surface 140 closest to hole 84 and one edge of opening 146 measures preferably about 1.563 inches. The length x of opening 146 is preferably about 0.562 inch, and the width u of opening 146 is preferably about 0.279 inch. A distance q between the edge of surface 140 furthest from hole 84 on the one hand and a transition point 148 (see FIG. 7*a*) between rounded region 130 and angled region 132, is preferably about 0.813 inch. Additionally, a shortest distance w between a center of hole 141 and line 150 measures preferably about 0.48 inch, while a shortest distance y between an edge of opening 146 and line 150 measures preferably about 0.292 inch.

Referring now to FIG. 7*c*, connecting rail 16/18 has an outer thickness g' of preferably about 0.375 inch, and an inner thickness f' of preferably about 0.279 inch. A wall thickness h' of the connecting rail 16/18 is further preferably about 0.048 inch.

While FIGS. 6*a*–6*c* and 7*a*–7*c* show, respectively, a presser rail 14 and a connecting rail 16/18 according to a preferred embodiment of the present invention, it is to be understood that other preferred embodiments of the presser rail 14 and of the connecting rail 16/18 include those embodiments where at least two or more of the respective dimensions mentioned above, although not equal or approximately equal to the stated dimensions above, exhibit approximately the same proportions as corresponding ones of the stated dimensions above.

Another embodiment of the present invention is shown in FIGS. 9*a*–13*b*. According to this embodiment, a presser rail 214 is provided similar to the presser rail 14 shown in the embodiment of FIGS. 1–3. The presser rail 214 includes recesses 216, 218 which function in a similar manner as recesses 100 shown in FIGS. 1–3. The presser rail 214 of FIGS. 9*a*–9*c* includes a frictionally engaging pad 220 that acts in a fashion similar to pad 96 shown in the embodiment of FIGS. 1–3. The presser rail 214 includes cut-out portions 222, 224 for accommodating biasing coil springs such as those shown and described in connection with FIGS. 11*a*–11*c*.

Figure 9C:
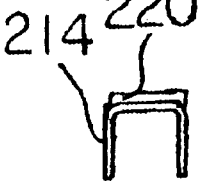
FIGS. 9*a*–9*c* are a side view, a bottom view, and an end view, respectively, of a presser rail according to yet another embodiment of the present invention.
Figure 9A:
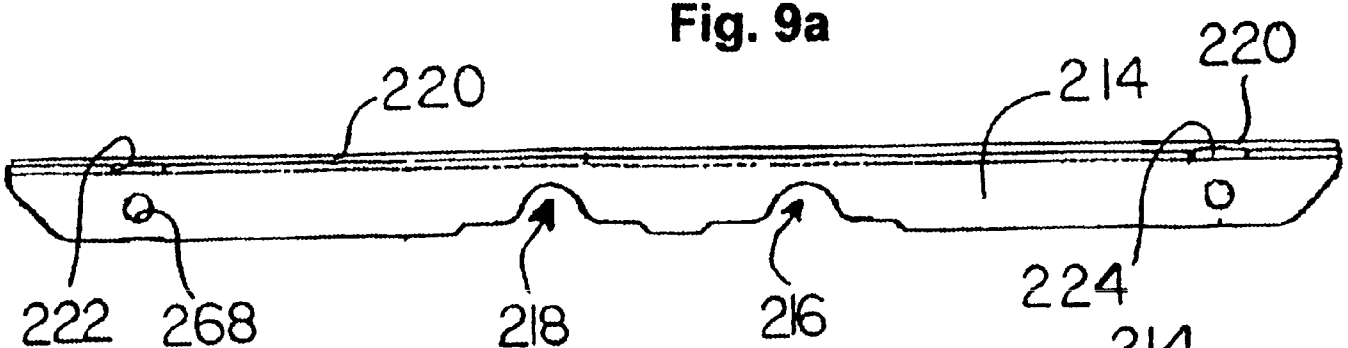
Figure 9B:
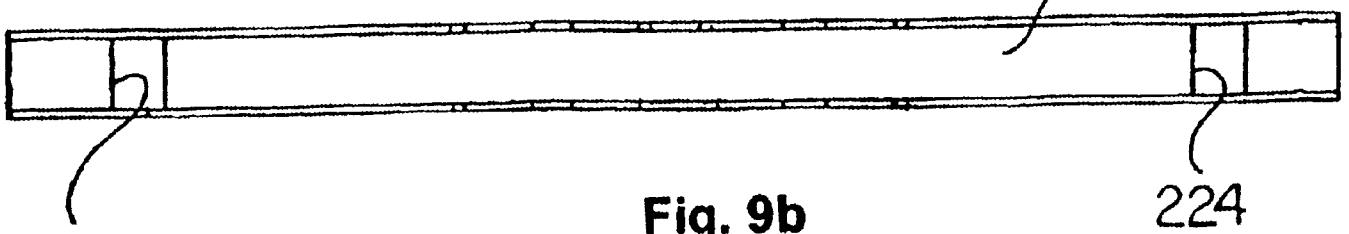
Figures 10A, 10B, 10C:
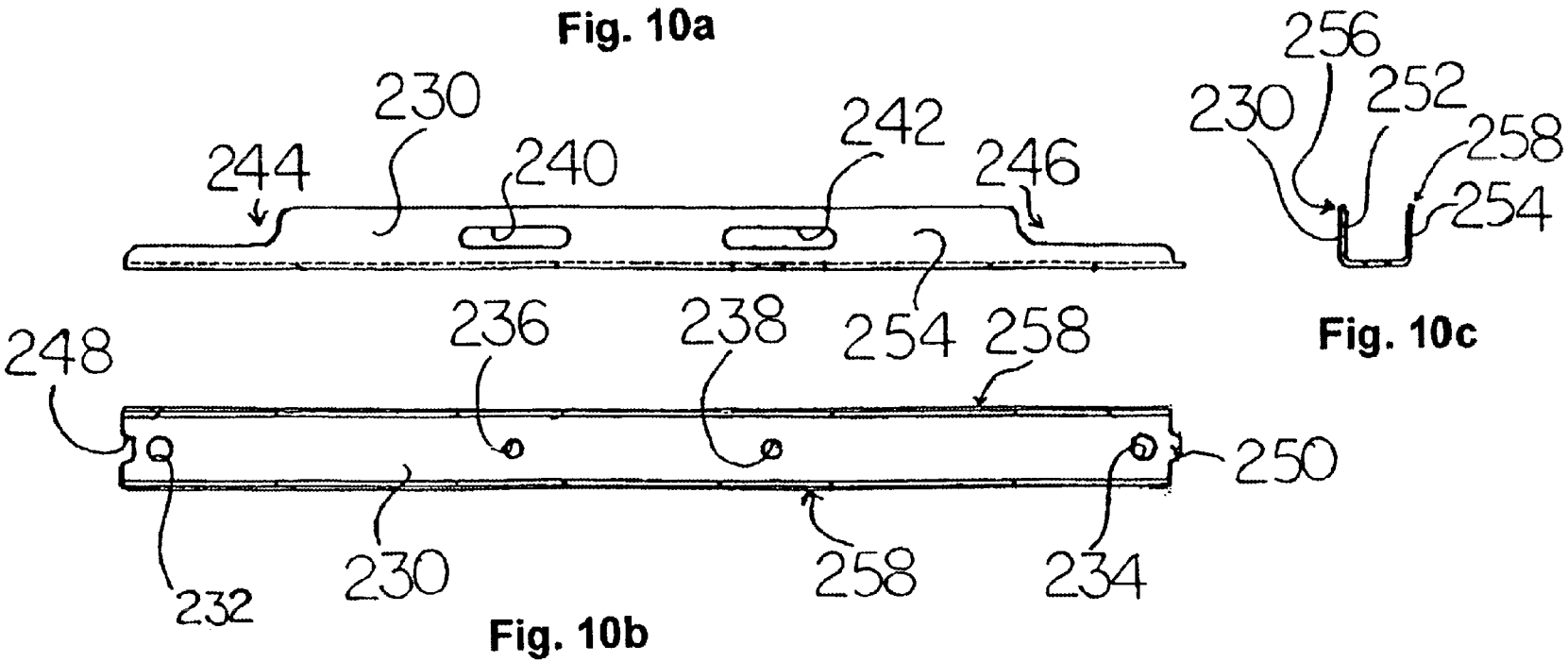
FIGS. 10*a*–10*c* are a side view, a top view, and an end view, respectively, of a support rail according to yet another embodiment of the present invention.

FIGS. 10*a*–10*c* show a support rail 230 used in conjunction with the presser rail 214 of FIGS. 9*a*–9*c*. The support rail 230 included mounting holes 232, 234, 236, 238 for mounting the support rail to 230 to a press, such as a blanking press (not shown). The support rail 230 includes guide slots 240, 242 for accommodating guide pins or rivets (not shown) used to connect connecting rails to the support rail 230. Support rail 230 also includes cut-out regions 244, 246 for accommodating guide pins or rivets used to connect a presser rail to connecting rails in a similar arrangement as shown with respect to FIGS. 1–3. Presser rail 230 also includes a notch 248 and a protrusion 250 designed to mate with a corresponding protrusion and a corresponding notch, respectively, of adjacent support rails so that adjacent support rails can be closely mounted to support rail 230, on a press device. Support rail 230 is also provided with sidewalls 252 and 254, each of which terminates in a flanged distal portion 256, 258, respectively. The flanged portions 256 and 258 are designed to accommodate a presser rail, such as presser rail 214 (shown in FIGS. 9*a*–9*c*), when a presser assembly including support rail 230 and presser rail 214 is in a completely folded position.

FIGS. 11*a*–11*c* show portions of a presser assembly that includes a presser rail 214 and support rail 230 as shown in FIGS. 9*a*–10*c*. Presser rail 214 is connected to support rail 230 by a connecting rail 260. While a guide pin 262 and locking ring 264 are shown connecting the connecting rail 260 to support rail 230, it is to be understood that a rivet can be used instead. The connecting rail 260 is connected to presser rail 214 by a rivet 266 extending through a hole 268 (shown in FIG. 9*a*), and through a hexagonal bushing 268 (FIGS. 13*a* and 13*b*) that is fitted in hexagonal holes provided in the connecting rail 260. The rivet 266 extends through the hexagonal bushing 268. The hexagonal bushing 268 is preferably made of a hard plastic material such as polytetrafluoroethylene or NYLATRON. The connecting rail 260 is preferably biased away from presser rail 214 by a coil spring 270 through which a furrel 272 (FIGS. 12*a* and 12*b*) extends. The hexagonal busing 268 in turn extends through the furrel 272. Ends 274 and 276 of the coil spring 270 bias against surfaces of the presser rail 214 and connecting rail 260, respectively. The furrel 272 is preferably made of a stainless steel material. The furrel 272 has a smaller diameter portion 280 that is just slightly smaller than the internal diameter of the coil spring 270. The furrel 272 has a larger diameter portion 282 having a diameter that is larger than the outer diameter of the coil spring 270.

Preferably, according to the present invention, at least the support rail, presser rail, and connecting rails are made of steel or aluminum, and are die punched for rigidity. The support rail, presser rail, and/or connecting rail can be made of a hard, durable plastic material. The glide supports are in turn preferably made of a hard, durable plastic, preferably a slidable plastic such as polytetrafluoroethylene or another fluoropolymer.

As can be appreciated from the figures, the connecting rails are configured for effecting a folding of the presser assembly such that, in a fully folded state of the presser assembly, the support rail, the connecting rail, and the presser rail are substantially parallel to one another. Advantageously, the invention provides a presser assembly that is easy to install on male blanker boards and that, by virtue of its simple construction, is easily manufactured, is generally less costly to manufacture than presser assemblies of the prior art, and is removed from male blanker boards of blanking devices with ease for being changed or reused. Furthermore, the presser assembly according to the present invention maintains the advantages of prior art presser assemblies, such as the ability to adjust to unequal pressure on the assembly, while substantially eliminating the possibility that the assembly will jam, as happens with presser assemblies of the prior art using guide cylinders. Additionally, the presser assembly according to a preferred embodiment of the present invention, unlike the presser assemblies of the prior art, does not require height adjustment, and thus can be much more efficiently mounted onto male blanker boards. Typically, the presser assembly according to a preferred embodiment of the present invention may be mounted or installed in two to three minutes.

The present invention further includes a kit for forming a presser assembly for supporting blanking scrap during a blanking operation. The kit according to the present invention includes: a support rail, such as support rail 12; a presser rail, such as presser rail 14 adapted to be connected to the support rail; and at least one connecting rail adapted to connect the presser rail to the support rail and adapted to pivot with respect to at least one of the support rail and the presser rail in an assembled state of the presser assembly through a predetermined pivot angle range for changing a distance between the support rail and the presser rail. A reduction of the distance between the support rail and the presser rail, such as of the distance D shown in FIG. 1, affects a folding of the presser assembly during the blanking operation. The kit according to the present invention encompasses the components of the presser assembly adapted to be connected to one another for forming the presser assembly. Thus, the kit includes, in a preferred embodiment of the present invention, the first connecting rail and the second connecting rail adapted to connect the presser rail to the support rail, respectively, at the first end and at the second end thereof The kit according to the preferred embodiment of the present invention further includes the biasing mechanism, which in turn includes the torsion or coil spring.

In operation, as is readily recognizable to those skilled in the art, the support rail may be pushed toward the presser rail for pivoting the connecting rails with respect to at least one of the support rail and the presser rail for reducing the angle a thereby folding the presser assembly and reducing a distance between the presser rail and the support rail. For unfolding the presser assembly, the method according to the present invention includes the step of pivoting the connecting rails 16 and 18 with respect to at least one of the support rail and the presser rail for increasing the angle a defined therebetween, thereby unfolding the presser assembly for increasing a distance between the presser rail and the support rail. For achieving a fully folded state of the presser assembly, the method according to the present invention includes the step of pivoting the connecting rail for achieving a fully folded state of the presser assembly wherein the support rail, the connecting rail and the presser rail are substantially parallel with respect to one another, and preferably such that the presser rail almost fully rests within a groove of the support rail.

The present invention further includes within its scope a presser assembly for supporting blanking scrap during a blanking operation, the presser assembly including: a support means; a presser means connected to the support means and supported thereby; and a connecting means for connecting the presser means to the support means and being adapted to pivot with respect to the presser means through a predetermined pivot angle range for changing a distance between the presser means and the support means thereby selectively effecting a folding and an unfolding of the presser assembly during the blanking operation. The means mentioned above are substantially shown and described in relation to FIGS. 1 through 7*c*.

The present invention also relates to a blanking press, printing press, stripping press, punching press, embossing press, or other press device that includes a presser assembly according to the present invention, and methods of forming blanks or other products by using such a press device and presser assembly.

It will be apparent to those skilled in the art that the disclosed invention may be modified in numerous ways and may assume many embodiments other than the preferred forms specifically set out and described above. Accordingly, it is intended by the appended claims to cover all modifications of the invention that fall within the true spirit and scope of the invention.

What is claimed is:

1. A presser assembly for supporting blanking scrap during a blanking operation, the presser assembly comprising:

a support rail;

a presser rail connected to the support rail, the presser rail comprising an elongated member having two side walls and a bottom wall together defining a trough; and a connecting rail connecting the presser rail to the support rail and being adapted to pivot with respect to at least one of the support rail and the presser rail through a predetermined pivot angle range for changing a distance between the support rail and the presser rail thereby selectively effecting a folding and an unfolding of the presser assembly during the blanking operation;

wherein the connecting rail comprises a presser end and a support end and is pivotally connected to the presser rail such that the presser end thereof is disposed in the trough.

2. The presser assembly according to claim 1, wherein:

the presser rail is connected to the support rail respectively at a first end and at a second end thereof;

the connecting rail comprises a first connecting rail and a second connecting rail connecting the presser rail to the support rail respectively at the first end and at the second end thereof, the first connecting rail and the second connecting rail each being adapted to independently pivot with respect to at least one of the support rail and the presser rail for changing a distance between the support rail and the presser rail to thereby enable folding of the presser assembly during the blanking operation.

3. The presser assembly according to claim 2, further comprising a biasing mechanism for biasing the presser rail away from the support rail, wherein:

each of the first connecting rail and the second connecting rail has a presser end and a support end; and the biasing mechanism comprises a torsion spring disposed at, at least one of the presser end and the support end of at least one of the first connecting rail and the second connecting rail.

4. The presser assembly according to claim 3, wherein the torsion spring includes a first torsion spring and a second torsion spring disposed at the presser end of the first connecting rail and at the presser end of the second connecting rail, respectively.

5. The presser assembly according to claim 3, further including a first pin and a second pin respectively extending through the presser ends of the first connecting rail and the second connecting rail for pivotally securing the first connecting rail and the second connecting rail to the presser rail.

6. The presser assembly according to claim 2, wherein the first connecting rail and the second connecting rail extend, in a default mode thereof, at an angle of about 45 degrees between the support rail and the presser rail.

7. The presser assembly according to claim 1, wherein the two side walls are parallel.

8. The presser assembly according to claim 2, wherein the presser rail further includes two pairs of recesses therein, each pair of the two pairs including a first recess in one sidewall of the presser rail and a second slot in another, facing sidewall of the presser rail, the recesses of each pair of recesses being in registration with one another in a direction transverse to a longitudinal direction of the presser rail, the two pairs of recesses further being disposed at a central region of the presser rail and being spaced from one another.

9. The presser assembly according to claim 8, wherein the two pairs of recesses are spaced from one another such that a distance c between centers thereof is about 1.5 inches.

10. The presser assembly according to claim 8, wherein a ratio of a distance between centers of the two pairs of recesses and a length of the presser rail is about 0.2:1.

11. The presser assembly according to claim 8, wherein each of the recesses of the two pairs of recesses is semicircular.

12. The presser assembly according to claim 2, wherein:

each of the first connecting rail and the second connecting rail includes a support end and a presser end;

the presser rail defines a first hole at a first end thereof and a second hole at a second end thereof and the presser assembly further comprises:

a first pin and extending through the first hole of the presser rail and through the presser end of the first connecting rail for pivotally securing the first connecting rail to the presser rail; and a second pin and extending through the second hole of the presser rail and through the presser end of the second connecting rail for pivotally securing the second connecting rail to the presser rail.

13. The presser assembly according to claim 12, wherein a ratio of a distance between centers between the first hole and of the second hole and a length of the presser rail is about 0.8 or greater.

14. The presser assembly according to claim 2, wherein the support rail is an elongated member defining a trough therein, the first connecting rail and the second connecting rail each having a presser end and a support end and further being slidably guidable within the trough at support ends thereof.

15. The presser assembly according to claim 14, wherein:

the support rail defines two pairs of guide slots therein, each pair of the two pairs including a first slot in one sidewall of the support rail and a second slot in another, facing sidewall of the support rail, said slots of each pair of slots being in registration with one another in a direction transverse to a longitudinal direction of the support rail;

the presser assembly further comprises a sliding mechanism for effecting a sliding of the support ends of the first connecting rail and the second connecting rail within the trough, the sliding mechanism including a first guide pin and a second guide pin extending through the support ends of the first connecting rail and the second connecting rail respectively and further being slidably guided within the two pairs of guide slots.

16. The presser assembly according to claim 15, wherein the sliding mechanism further includes a first glide support and a second glide support connected to the support ends of the first connecting rail and the second connecting rail, respectively, each glide support being configured to be guided within the trough for slidably guiding the support ends in the trough.

17. The presser assembly according to claim 16, further comprising a lubricant disposed in the trough for lubricating a sliding motion of each glide support within the trough.

18. The presser assembly according to claim 15, wherein the two pairs of guide slots are spaced from one another such that, in a fully folded state of the presser assembly, the support rail, the connecting rail and the presser rail are substantially parallel to one another, and the first guide pin and the second guide pin each are received in a respective one of the two pairs of guide slots.

19. The presser assembly according to claim 1, further comprising a biasing mechanism for biasing the presser rail away from the support rail.

20. The presser assembly according to claim 19, wherein the biasing mechanism is coupled to at least one of two ends of the connecting rail.

21. The presser assembly according to claim 20, wherein the biasing mechanism comprises a torsion spring.

22. The presser assembly according to claim 1, wherein the two sides are slanted with respect to the top surface and to the bottom surface.

23. The presser assembly according to claim 22, wherein the two sides are slanted with respect to the top surface and to the bottom surface by angle $\gamma$ equal to about 45 degrees.

24. The presser assembly according to claim 22, wherein each of the sides has a first rounded edge and a second rounded edge.

25. The presser assembly according to claim 24, wherein the first rounded edge defines a radius of curvature of about 0.125 inch, and the second rounded edge defines a radius of curvature of about 0.188 inch.

26. The presser assembly according to claim 1, wherein the connecting rail has a presser end and a support end.

27. The presser assembly according to claim 26, wherein the support end of the connecting rail includes a rounded portion and an angled portion adjoining the rounded portion.

28. The presser assembly according to claim 26, further comprising a support pin, wherein the support end of the connecting rail defines a hole for receiving the support pin therein, the support pin thereby being adapted to pivotally secure the connecting rail to the support rail.

29. The presser assembly according to claim 28, wherein the hole for receiving the support pin is generally circular and further has a straight region.

30. The presser assembly according to claim 26, wherein the connecting rail is an elongated member defining an outer surface and an inner surface.

31. The presser assembly according to claim 30, wherein said side has a truncated corner adjoining the outer surface of the connecting rail.

32. The presser assembly according to claim 31, wherein the truncated corner has a height of about 0.06 inch.

33. The presser assembly according to claim 30, wherein the presser end of the connecting rail has a side slanted with respect to the outer surface and the inner surface of the connecting rail.

34. The presser assembly according to claim 33, wherein said side has a rounded edge adjoining the inner surface of the connecting rail.

35. The presser assembly according to claim 34, wherein the rounded edge defines a radius of about 0.2 inch.

36. The presser assembly according to claim 33, wherein the side is slanted with respect to the outer surface and the inner surface of the connecting rail by an angle $\mu$ of from about 40 to about 45 degrees.

37. The presser assembly according to claim 33, further comprising a biasing mechanism for biasing the presser rail away from the support rail, wherein the outer surface of the connecting rail defines an opening therein for accommodating at least a portion of the biasing mechanism therein in a fully folded state of the presser assembly.

38. The presser assembly according to claim 1, further comprising a pad fixed to a lower surface of the presser rail for frictionally engaging a scrap thereunder during a blanking operation.

39. The presser assembly according to claim 1, wherein the connecting rail is configured for effecting a folding of the presser assembly such that, in a fully folded state of the presser assembly, the support rail, the connecting rail and the presser rail are substantially parallel to one another.

40. A blanking press comprising a press and the presser assembly of claim 1.

41. A method comprising:

providing the presser assembly of claim 1;

pivoting the connecting rail with respect to at least one of the support rail and the presser rail for reducing an angle defined therebetween thereby folding the presser assembly for reducing a distance between the presser rail and the support rail; and pivoting the connecting rail with respect to at least one of the support rail and the presser rail for increasing an angle defined therebetween thereby unfolding the presser assembly for increasing a distance between the presser rail and the support rail.

42. The method according to claim 41, wherein the step of pivoting the connecting rail with respect to the presser rail for reducing includes the step of pivoting the connecting rail for achieving a fully folded state of the presser assembly wherein the support rail, the connecting rail and the presser rail are substantially parallel with respect to one another.

43. A kit for forming a presser assembly for supporting blanking scrap during a blanking operation, the kit comprising:

a support rail;

a presser rail adapted to be connected to the support rail, the presser rail comprising an elongated member having two side walls and a bottom wall together defining a trough; and a connecting rail adapted to connect the presser rail to the support rail and adapted to pivot with respect to at least one of the support rail and the presser rail in an assembled state of the presser assembly through a predetermined pivot angle range for changing a distance between the support rail and the presser rail thereby selectively effecting a folding and an unfolding of the presser assembly during the blanking operation;

wherein the first connecting rail comprises a presser end and a support end and is pivotally connected to the presser rail such that the presser end thereof is disposed in the trough.

44. The kit according to claim 43, wherein:

the presser rail is adapted to be connected to the support rail respectively at a first end and at a second end thereof;

the connecting rail comprises a first connecting rail and a second connecting rail adapted to connect the presser rail to the support rail respectively at a first end and at a second end of the connecting rail, the first connecting rail and the second connecting rail each being adapted to independently pivot with respect to at least one of the support rail and the presser rail in an assembled state of the presser assembly for changing a distance between the support rail and the presser rail thereby folding the presser assembly during the blanking operation.

45. The kit according to claim 43, further comprising a biasing mechanism for biasing the presser rail away from the support rail, the biasing mechanism being adapted to be coupled to at least one of the two ends of the connecting rail.

46. The kit according to claim 45, wherein the biasing mechanism comprises a torsion spring.

47. A presser assembly for supporting blanking scrap during a blanking operation, the presser assembly comprising:

a support means;

a presser means connected to the support means and supported thereby, the presser means comprising an elongated member having two side walls and a bottom wail together defining a trough; and a connecting means for connecting the presser means to the support means and being adapted to pivot with respect to the presser means through a predetermined pivot angle range for changing a distance between the presser means and the support means thereby selectively effecting a folding and an unfolding of the presser assembly during a blanking operation;

wherein the first connecting means comprises a presser end and a support end and is pivotally connected to the presser means such that the presser end thereof is disposed in the trough.

* * * * *